US005687955A

United States Patent [19]

Bonser et al.

[11] Patent Number: 5,687,955

[45] Date of Patent: Nov. 18, 1997

[54] PRETENSIONING DEVICE FOR AUTOMATIC LINE SPLICE

[75] Inventors: Ralph G. Bonser, Livonia; Mitchell D. Charneski, Southfield; Daniel J. Dunlop, Sterling Heights; Gerry E. McDonnell, Plymouth, all of Mich.

[73] Assignee: The Detroit Edison Company, Detroit, Mich.

[21] Appl. No.: 600,201

[22] Filed: Feb. 12, 1996

[51] Int. Cl.[6] ..... B66F 3/02

[52] U.S. Cl. ..... 254/237

[58] Field of Search ..... 254/230, 237, 254/238, 239, 240

[56] References Cited

U.S. PATENT DOCUMENTS

| | | | |
|---|---|---|---|
| 2,978,803 | 4/1961 | Davies | 29/282 |
| 3,098,275 | 7/1963 | Schweitzer | 24/126 |
| 3,345,454 | 10/1967 | Mixon, Jr. | 174/84 |
| 3,826,860 | 7/1974 | De Sio et al. | 174/73 |
| 4,339,113 | 7/1982 | Vosper | 254/13 |
| 4,512,828 | 4/1985 | Helm | 156/49 |

*Primary Examiner*—Katherine Matecki

*Attorney, Agent, or Firm*—Barnes, Kisselle, Raisch, Choate, Whittemore & Hulbert, P.C.

[57] ABSTRACT

A pretensioning device for causing an automatic line splice to exert a strong grip on the ends of two cables inserted into opposite ends of the automatic line splice. The pretensioning device has a rack supported for sliding movement in a rectangular tube. The rack has a series of teeth along its length. A sled mounted on the rectangular tube has a dog engageable with any one of the teeth on the rack. A cam on the rectangular tube is provided for moving the sled lengthwise of the rectangular tube while the dog engages a tooth of the rack to extend the rack. A clamp on the rectangular tube grips one of the cables and a clamp on the rack grips the other cable.

6 Claims, 3 Drawing Sheets

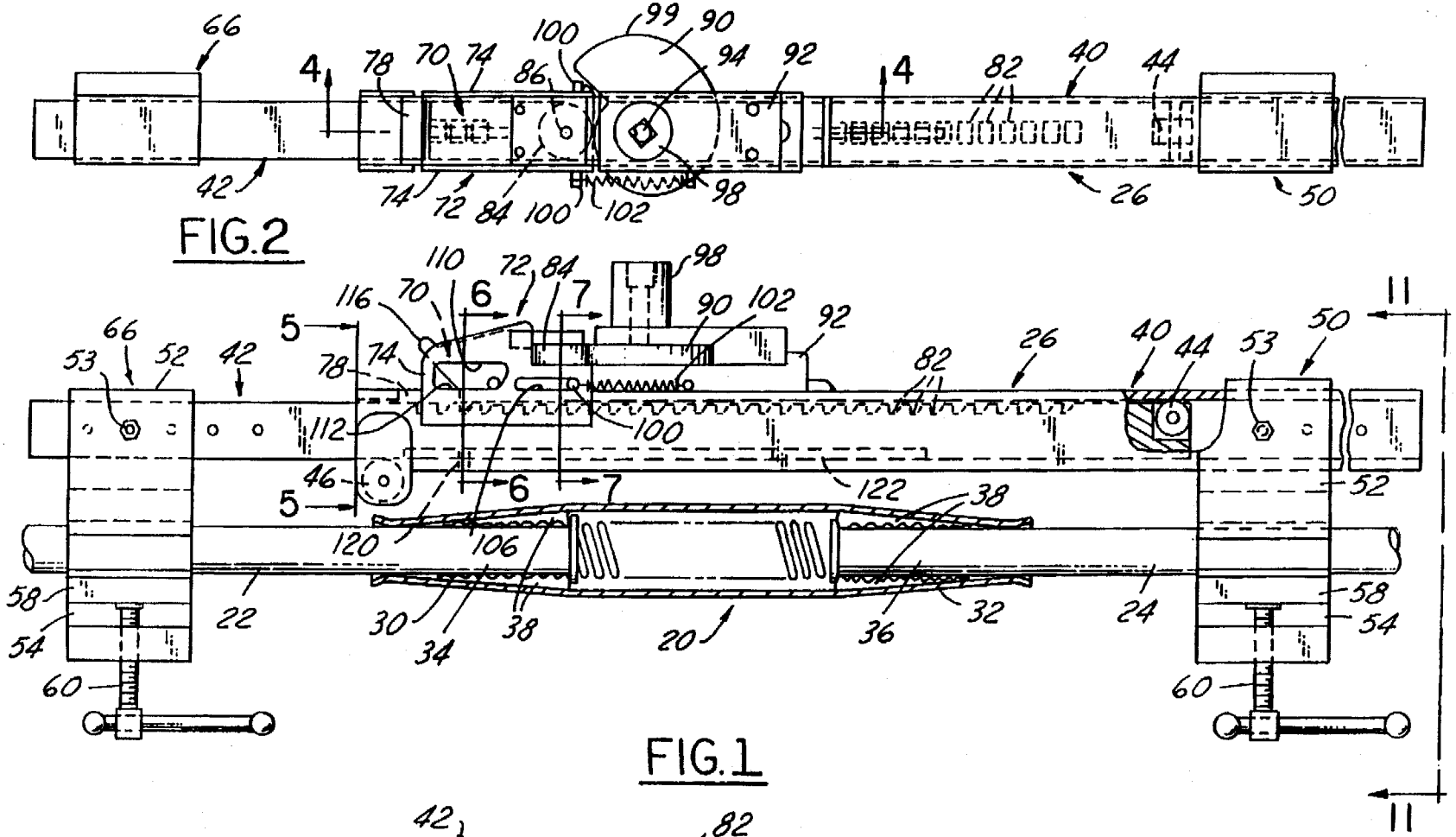
FIG.1
FIG.2
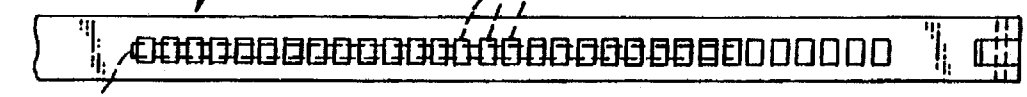
FIG.3

PRETENSIONING DEVICE FOR AUTOMATIC LINE SPLICE

FIELD OF INVENTION

This invention relates to a pretensioning device for producing a strong grip on the ends of cables inserted in the opposite ends of the line splice.

BACKGROUND OF THE INVENTION

A line splice is employed to mechanically and electrically interconnect the ends of two cables. The splice comprises a tube with tapered ends into which the cable ends are inserted. Jaws inside the tapered ends are for gripping the cables. When tension is applied on the cable ends, the jaws grip the cables and prevent them from being pulled out.

It is important for the jaws to have a strong grip on the cable ends. Otherwise, the splice may fail. Also, a loose grip on the cable ends is more apt to overheat and cause failure.

In the past, pretensioning has been time consuming and not entirely successful. What is needed is a device which will pretension both cables at the same time, fast and effectively which the pretensioning device of this invention is designed to do. Automatic line splices are not used in slack spans. This pretensioning device makes such installations now possible.

SUMMARY OF THE INVENTION

The pretensioning device of this invention causes the automatic line splice to exert a strong grip on the ends of two cables inserted into the opposite ends of the automatic line splice, by pulling outwardly on the two cables simultaneously. The device comprises a rack slidable lengthwise within an elongated rectangular tube. A clamp on the tube is adapted to grip one of the cables and a clamp on the rack is adapted to grip the other cable. Preferably, the rack has a series of teeth, and a sled mounted on the tube has a dog engageable with any one of the rack teeth. Preferably, a cam is provided for moving the sled in one direction lengthwise of the tube while the dog engages a tooth on the rack to extend the rack and thereby impose an outward pull on both cables.

The sled is preferably mounted on the tube by a support comprising a pair of laterally spaced guide plates. The guide plates preferably have slots extending lengthwise of the tube, and pins on the sled slidably and pivotally engage the respective slots so that the sled can move lengthwise of the slots and can pivot sufficiently to engage and disengage the rack teeth.

One object of this invention is to provide a pretensioning device having the foregoing features and capabilities.

Another object is to provide a pretensioning device which is composed of a relatively few simple parts, is light in weight, is rugged and durable in use, can be easily and effectively operated, and is capable of being readily and inexpensively manufactured and assembled.

These and other objects, features and advantages of the invention will become more apparent as the following description proceeds, especially when considered with the accompanying drawings.

BRIEF DESCRIPTION OF THE DRAWINGS

FIG. 1 is a side elevational view of a pretensioning device constructed in accordance with this invention, with parts broken away and in section, and shown in association with a automatic line splice and two cables extending into the opposite ends of the automatic line splice.

FIG. 2 is a top plan view of the pretensioning device shown in FIG. 1.

FIG. 3 is a fragmentary top view of the rack which forms a part of the pretensioning device, illustrating the rack teeth.

DETAILED DESCRIPTION OF THE PREFERRED EMBODIMENT

Figure 4:
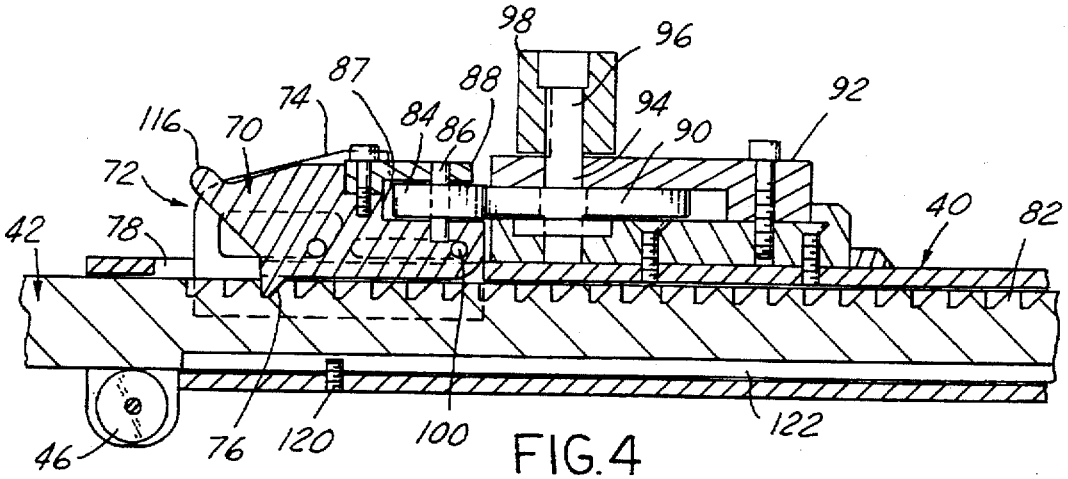
FIG. 4 is a fragmentary sectional view taken on the line 4—4 in FIG. 2.
Figure 5:
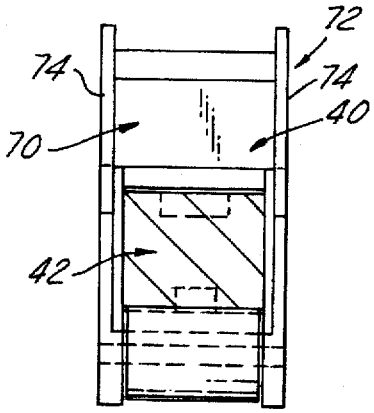
FIG. 5 is a sectional view taken on the line 5—5 in FIG. 1.
Figure 6:
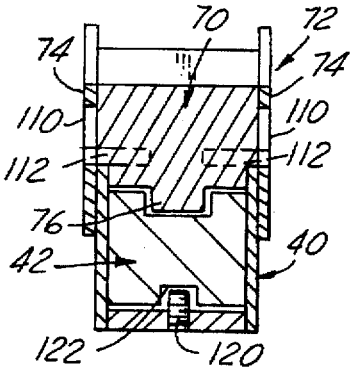
FIG. 6 is a sectional view taken on the line 6—6 in FIG. 1.
Figure 7:
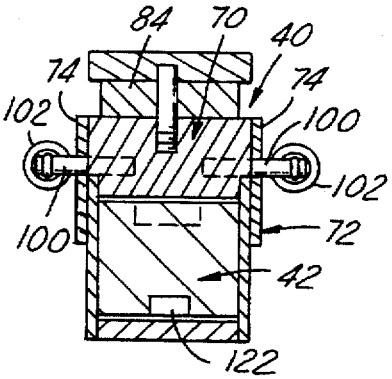
FIG. 7 is a sectional view taken on the line 7—7 in FIG. 1.

Referring now more particularly to the drawings, there is shown a line splice 20,-electrical cables 22 and 24, and a pretensioning device 26 constructed in accordance with this invention.

The line splice 20 is in the form of an elongated, open-ended tube having tapered end portions 30 and 32. The ends 34 and 36 of cables 22 and 24 extend into the tapered end portions 30 and 32 of the splice. Inside the tapered end portions 30 and 32 are jaws 38 which surround the cable ends 34 and 36. The jaws grip the cable ends to prevent them from pulling out. In fact, outward tension applied to the cable ends draws the jaws radially inwardly because of their engagement with the inner walls of the tapered end portions of the splice, thereby increasing the grip of the jaws on the cables.

As stated above, it is important for the jaws to have a strong grip on the cable ends. Otherwise, the splice may fail. Also, a loose grip is more apt to cause overheating.

The pretensioning device 26 comprises an elongated rectangular tube 40 and an elongated rack 42 slidable lengthwise within the tube. A roller 44 is mounted on the inner end of the rack 42 for engagement with the inner wall of the tube 40. A roller 46 is mounted on the outer end of the tube for engagement with the rack. These rollers 44 and 46 insure a smooth guided longitudinal movement of the rack within the tube.

Figure 11:
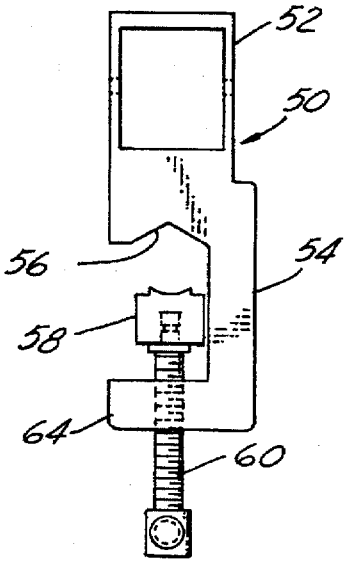
FIG. 11 is a view taken on the line 11—11 in FIG. 1, showing one of the cable clamps but omitting the cable and pretensioning device.

A clamp 50 has a body portion 52 secured in longitudinally adjusted position to the inner end of the tube 40 by fasteners 53- The clamping portion 54 of clamp 50 is C-shaped to receive the cable 24. The cable 24 is adapted to be gripped between the base 56, see FIG. 11, of the clamping portion 54 and an adjustable clamp bar 58 which is mounted on a screw 60. The screw 60 threads through a flange 64 of the clamping portion 54. By rotating of the screw, the clamp bar 58 can be moved toward or away from the base 56 to clamp or unclamp the cable end.

A clamp 66, which is similar to clamp 50 except for a smaller mounting base, is secured in longitudinally adjusted position to the outer end of the rack 42. The parts of the clamp 66 bear the same reference numerals as those of the clamp 50 and it will be seen that the clamp 66 clamps the cable 22.

A sled 70 is mounted on the top of rectangular tube 40 near the outer end thereof. The sled is mounted on a sled support 72. Support 72 comprises a pair of laterally spaced, parallel guide plates 74 which are secured to opposite sides of the tube 40 near its outer end and project upwardly above the tube. The sled 70 has a projection or dog 76 which extends downwardly through an opening 78 in the tube to engage any one of the series of rack teeth 82 formed along the length of the rack.

The sled 70 has a roller 84 which turns on the vertical axis of pin 86 and is retained in a recess 87 in the sled by a fixed plate 88 carried by the sled.

A cam 90 is carried by a housing 92 affixed to the top of the rectangular tube 40. The cam is rigidly connected to a vertical shaft 94 supported in the housing 92 for rotation. The shaft 94 has an upward extension 96 provided with an enlarged handle 98 by means of which the cam may be rotated. The cam has a cam surface 99 of gradually increasing radius as seen in FIG. 2.

Figure 8:
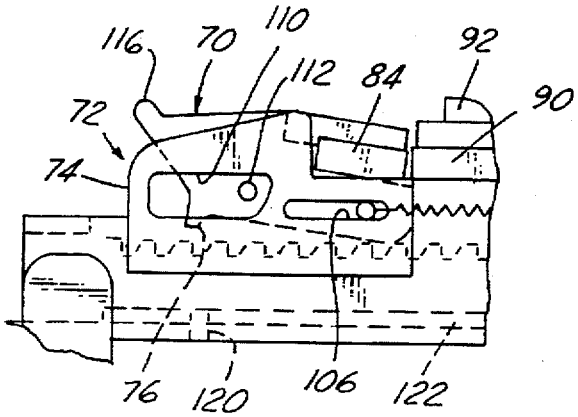
FIG. 8 is a fragmentary side elevational view of a portion of the structure in FIG. 1, with the parts in a different position.

The sled 70 is provided with laterally outwardly extending guide pins 100. Tension coil springs 102 secured at one end to the opposite sides of the housing 92 and at their other ends to the respective pins 100 draw the sled toward the cam to hold the cam surface 99 in contact with the roller 84. The guide pins 100 are guided in elongated, laterally aligned slots 106 provided in the guide plates 74. The sled 70 can pivot from the position of FIG. 4 in which the dog 76 engages one of the rack teeth 82 to the raised position of FIG. 8 in which the dog 76 disengages the rack teeth.

The guide plates 74 have registering openings 110. Projections 112 on opposite sides of the sled 70 extend into the openings 110. The cooperation of the projections 112 and openings 110 limits the pivotal movement of the sled about pins 100 in all positions of the pins along the length of the slots 106 and accordingly in all positions of the sled along the rectangular tube 40.

The sled has an extension 116 which may be gripped to manually pivot the sled with respect to pins 100, to engage or disengage the dog 76 with respect to a selected tooth 82 on the rack 42.

A pin 120 in the bottom wall of rectangular tube 40 extends into an elongated slot 122 in the bottom of rack 42. The ends of the slot 122 limit the longitudinal sliding movement of the rack with respect to the rectangular tube.

Figure 9:
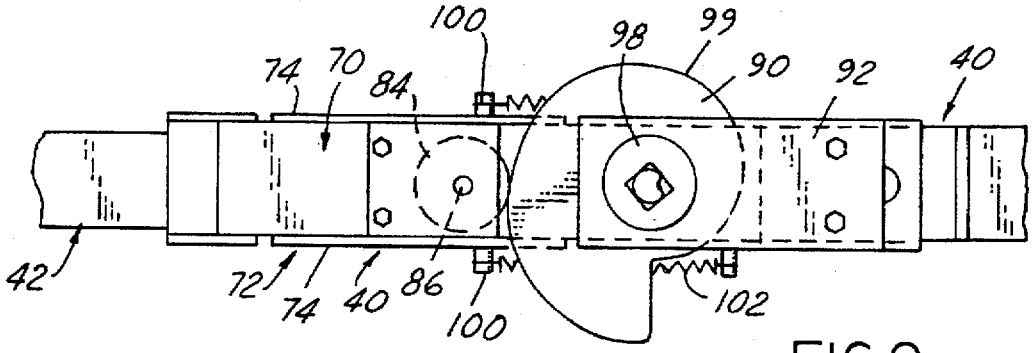
FIGS. 9 and 10 are fragmentary top and side elevational views of portions of FIGS. 2 and 1 respectively, but showing certain parts in a different position.
Figure 10:
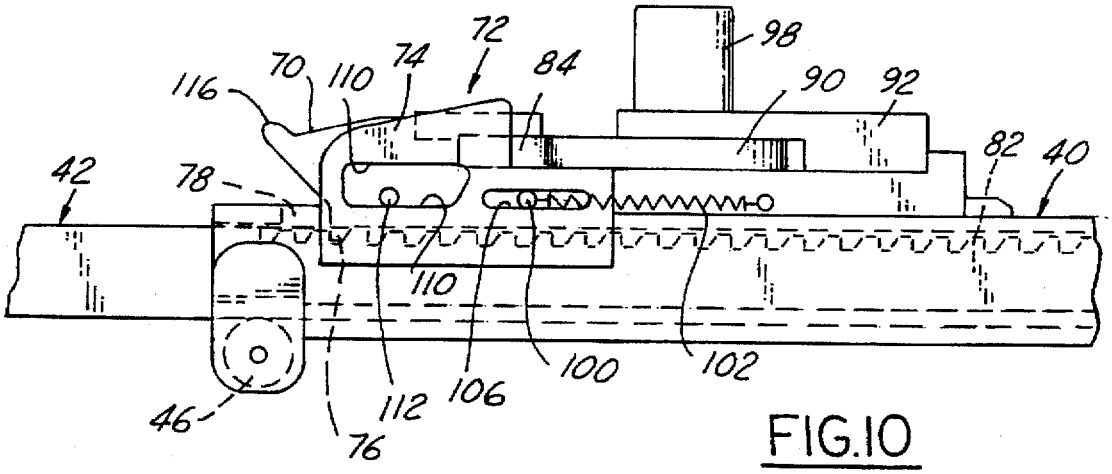

In use, the ends of the cables 22 and 24 are inserted into opposite ends of the automatic line splice, after which the clamps 50 and 66 are respectively engaged with and clamp on the cables 22 and 24 as shown in FIG. 1. In order to impose outward tension on the two cables simultaneously and thereby cause the jaws to grip the cable ends, the cam is initially rotated counterclockwise to the FIG. 2 position. The sled 70 is positioned so that its roller 84 contacts the cam surface 99 of cam 90 and pins 100 contact the inner ends (right ends in FIG. 1) of the slots 106 in the guide plates 74. The sled is lowered to cause the sled dog 76 to engage one of the teeth along the length of rack 42. Then by rotating the cam 90 from the FIG. 2 position clockwise to the FIG. 9 position, the sled is caused to move outwardly (to the left in FIG. 1), thereby extending the rack 42. If enough tension is not thereby placed on the cables to cause a sufficient gripping action of the jaws in the line splice on the cable ends, by reversing the cam the sled is raised to disengage the dog 76 from the rack tooth 82, the cam is returned to the FIG. 2 position and the dog is permitted to move inwardly or to the right in FIGS. 1 and 2 by the action of the springs 102. Then the cam 90 is again rotated clockwise in FIGS. 2 and 9 to further extend the rack 42 and place even more tension on the cable ends.

The cam may be turned by a torque wrench applied to handle 98. In one application of the invention, the cam has a one-inch throw in 270° of rotation and the teeth in the rack are approximately one-half inch apart. Thus, the rack can be moved one inch with one rotation of the cam and then the cam can be returned to the starting position. The sled, being spring loaded, returns and the dog drops into another notch between teeth. The amount of torque can be gauged by the resistance on the torque wrench during rotation of the cam. When enough torque is applied to get the proper tension on the cables, the pretensioning is complete. The clamps 50 and 66 are removed and the ends of the cables are now firmly gripped by the jaws of the line splice.

We claim:

1. A pretensioning device for causing the jaws of an automatic line splice to exert a strong grip on the ends of two cables inserted in opposite ends of the automatic line splice by pulling outwardly on the cables relative to the automatic line splice, said pretensioning device comprising:

an elongated tube, a clamp on said tube adapted to grip one of the cables, an elongated rack within said tube and slidable lengthwise thereof, a clamp on said rack adapted to grip the other of said cables, said rack having a series of teeth spaced apart along the length thereof, a sled mounted on said tube for movement lengthwise thereof and having a dog engageable with any one of the teeth on said rack, and means on said tube for moving the sled in one direction lengthwise of the tube while the dog engages a tooth of the rack to extend the rack relative to the tube, said means for moving the sled comprising a cam.

2. A pretensioning device for causing the jaws of an automatic line splice to exert a strong grip on the ends of two cables inserted in opposite ends of the automatic line splice by pulling outwardly on the cables relative to the automatic line splice, said pretensioning device comprising:

an elongated tube, a clamp on said tube adapted to grip one of the cables, an elongated rack within said tube and slidable lengthwise thereof, a clamp on said rack adapted to grip the other of said cables, said rack having a series of teeth spaced apart along the length thereof, a sled mounted on said tube for movement lengthwise thereof and having a dog engageable with any one of the teeth on said rack.

means on said tube for moving the sled in one direction lengthwise of the tube while the dog engages a tooth of the rack to extend the rack relative to the tube, a sled support on said tube, means on said sled support for guiding the movement of said sled, said sled support comprising a pair of laterally spaced guide plates mounted on said tube, and means on said sled having a slidable engagement with said guide plates.

3. A pretensioning device for causing the jaws of an automatic line splice to exert a strong grip on the ends of two cables inserted in opposite ends of the automatic line splice by pulling outwardly on the cables relative to the automatic line splice, said pretensioning device comprising:

an elongated tube, a clamp on said tube adapted to grip one of the cables, an elongated rack within said tube and slidable lengthwise thereof, a clamp on said tube adapted to grip the other of said cables, said rack having a series of teeth spaced apart along the length thereof, a sled mounted on said tube for movement lengthwise thereof and having a dog engageable with any one of the teeth on said rack, means on said tube for moving the sled in one direction lengthwise of the tube while the dog engages a tooth of the rack to extend the rack relative to the tube, a sled support on said tube, means on said sled support for guiding the movement of said sled, said sled support comprising a pair of laterally spaced, parallel guide plates mounted on said tube, elongated parallel slots in said respective guide plates extending lengthwise of said tube, and pins on said sled slidably and pivotally engaged in said respective slots so that said sled can move lengthwise of said slots and can pivot sufficiently to engage and disengage the rack teeth.

4. A pretensioning device as defined in claim 3, wherein said guide plates have means limiting the pivotal movement of said sled.

5. A pretensioning device as defined in claim 3, wherein said guide plates have registering openings and said sled has projections engaged in said openings to limit the pivotal movement of said slide.

6. A pretensioning device as defined in claim 5, wherein the means for moving said sled comprises a rotatable cam, a roller on said sled engageable with said cam, and a spring unit urging said sled toward said cam.

* * * * *